US007802936B1

(12) United States Patent
Izawa et al.

(10) Patent No.: US 7,802,936 B1
(45) Date of Patent: Sep. 28, 2010

(54) MECHANICAL PENCIL

(75) Inventors: Hirotake Izawa, Yokohama (JP); Takeshi Kobayashi, Yokohama (JP); Kyo Nakayama, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 12/741,136

(22) PCT Filed: Oct. 15, 2008

(86) PCT No.: PCT/JP2008/068632

§ 371 (c)(1),
(2), (4) Date: May 3, 2010

(87) PCT Pub. No.: WO2009/069390

PCT Pub. Date: Jun. 4, 2009

(30) Foreign Application Priority Data

Nov. 26, 2007 (JP) ..... 2007-304679

(51) Int. Cl.
*B43K 21/22* (2006.01)
*B43K 5/12* (2006.01)

(52) U.S. Cl. ..... 401/93; 401/92; 401/194

(58) Field of Classification Search ..... 401/92–94, 401/194

See application file for complete search history.

(56) References Cited

U.S. PATENT DOCUMENTS 2,262,649 A * 11/1941 Ponath ..... 401/93
2,751,700 A * 6/1956 Danjczek ..... 40/334
4,411,543 A * 10/1983 Hashimoto et al. ..... 401/53
6,481,908 B2 * 11/2002 Lychwick ..... 401/92
6,702,495 B1 * 3/2004 Lychwick ..... 401/92

FOREIGN PATENT DOCUMENTS

| | | | |
|---|---|---|---|
| JP | 54-25339 | U | 2/1979 |
| JP | 55-179882 | U | 12/1980 |
| JP | 59-107286 | U | 7/1984 |
| JP | 4-76489 | U | 7/1992 |
| JP | 10-329485 | A | 12/1998 |
| JP | 11-99795 | A | 4/1999 |
| JP | 3882272 | B2 | 2/2007 |
| JP | 3885315 | B2 | 2/2007 |

OTHER PUBLICATIONS

International Search Report of PCT/JP2008/068632, mailing date of Nov. 11, 2008.

* cited by examiner

*Primary Examiner*—David J Walczak
(74) *Attorney, Agent, or Firm*—Westerman, Hattori, Daniels & Adrian, LLP

(57) ABSTRACT

A chuck (4) for grasping a writing lead and a rotor (6) arranged to be movable in a direction of rotation and an axial direction within a body cylinder (1). A rotational drive mechanism for the writing lead is formed such that first and second cam faces (6*a*) and (6*b*) are respectively formed at one end face and another end face of the rotor in the axial direction, and first and second fixed cam faces (13*a*) and (14*a*) are arranged on the body cylinder side to face the above-mentioned first and second cam faces respectively. An indicator (6*c*) of a wedge-shaped notch is formed at a part of the rotor. The indicator can be observed through the body cylinder made of a transparent material. By this structure, a mechanical pencil is provided in which operation of the writing lead that is gradually rotated by way of writing pressure can be known certainly.

7 Claims, 10 Drawing Sheets

MECHANICAL PENCIL

TECHNICAL FIELD

The present invention relates to a mechanical pencil which can rotate a writing lead (refill lead) by writing pressure.

BACKGROUND ART

In the case of writing with a mechanical pencil, it is generally often the case that the mechanical pencil is not used in a situation where a body cylinder is perpendicular to a writing side (page), but used in a situation where the body cylinder is somewhat inclined to the writing side. In the case where the body cylinder is thus inclined for writing, there arises a phenomenon that a drawn line becomes bold as compared with that in the beginning, since the writing lead may locally abrade as the writing proceeds. Further, not only the drawn line changes in boldness, but also there arises a phenomenon that the drawn line changes in thickness (drawn line becomes thin) as the writing proceeds, since a contact area of the writing lead changes with respect to the writing side.

In order to avoid the above-mentioned problem, when the writing is carried out with the body cylinder being rotated, then it is possible to avoid such a problem that, as described above, the drawn line becomes bold as it is drawn, since a sharper side of the writing lead is rotatably in contact with the page when writing. However, when you write down with the body cylinder being rotated, there arises a problem in that operation of re-holding the body cylinder is required while the writing proceeds, leading to considerable reduction in writing efficiency.

In that case, it is not impossible to write down by re-holding the body cylinder and rotating it in a stepwise manner, in the case where exterior of the body cylinder is formed to be cylindrical. However, in the case of the mechanical pencil whose exterior may not be cylindrical and which may be designed to have a projection in the middle or which is a side-knock-type mechanical pencil, it is difficult to write by re-holding the body cylinder to be rotated in a stepwise manner as described above.

In order to solve such a problem, as described above, patent documents 1 through 3 disclose a mechanical pencil arranged such that a chuck for gripping a writing lead may be retreated by writing pressure, and having a rotational drive mechanism in which the above-mentioned writing lead together with the above-mentioned chuck is rotated by way of the retreat operation.

Patent Document 1: Japanese Patent No. 3882272

Patent Document 2: Japanese Patent No. 3885315

Patent Document 3: Japanese Utility Model Application Publication (KOKAI) No. S54-25339

DISCLOSURE OF THE INVENTION

Object of the Invention

Incidentally, according to the mechanical pencil disclosed in the above-mentioned patent documents 1 and 2, vertical projections and vertical recesses are arranged alternately in a body cylinder, and a cam part is annularly formed which has slopes each being across the vertical projection and recess. Further, a rotor having formed thereon projections at intervals in a circumferential direction is accommodated in the body cylinder. By retreating the writing lead greatly, the above-mentioned rotor is pushed upwards, and the projection of the rotor passes over the vertical projection formed at the cam part in the body cylinder and falls into the next vertical recess via the above-mentioned slope, to thereby rotate the rotor. In other words, the rotation operation of the above-mentioned rotor acts to cause the writing lead to rotate.

According to the above-mentioned mechanical pencil, when rotating the rotor, there is a problem in that the writing lead needs to have a large enough retreat stroke to allow the projection on the rotor side to pass over the vertical projection formed in the body cylinder. For this reason, special operation of rotating the writing lead in the middle of writing is required, and it is difficult to increase writing efficiency. Further, when rotationally operating the writing lead, it is not particularly arranged to know whether the above-mentioned rotor is surely rotationally operated.

In addition, in the preferred embodiments disclosed in patent documents 1 and 2 above, it is arranged that a knock cap projecting at a rear end of the body cylinder is also rotated interlocking with the rotation of the above-mentioned rotor. However, since the above-mentioned knock cap is formed in the shape of a simple cylinder, it is not easy to observe the cap rotating. Rather, when the above-mentioned knock cap is arranged to be rotated interlocking with it, there arises a problem that the knock cap may be, for example, unintentionally rotated to damage the rotational drive mechanism.

On the other hand, according to the mechanical pencil described in patent document 3, one having the rotational drive mechanism in a space between the base at a tip of and the body cylinder is disclosed, in which the writing lead may also be rotationally driven interlocking with the rotation of the base. In the structure described in this patent document 3, since the base is formed in the shape of a simple cone, it is not easy to check its rotation operation. Rather, when the above-mentioned base rotates, there arises a problem that the base is gripped etc., when writing so as to inhibit the rotation operation. Therefore, there is no way of thinking of positively knowing the rotation operation either in the mechanical pencil described in patent document 3 above.

The present invention arises in view of the problems of the mechanical pencil disclosed in the above patent documents and aims at providing a mechanical pencil in which a writing lead can be rotated by the action of writing pressure, wherein a part of a component accommodated in a body cylinder which is rotationally driven interlocking with a rotor for rotationally drive the writing lead or rotation of the rotor can be observed through the body cylinder made of a transparent material, to thereby know the above-mentioned rotation operation certainly without causing trouble in the rotation operation of the writing lead.

Means for Solving the Problems

The mechanical pencil in accordance with the present invention made in order to solve the above-mentioned problems is a mechanical pencil which is arranged such that a chuck provided in a body cylinder reciprocates so as to grasp and release a writing lead to inch the above-mentioned writing lead forward, in which the above-mentioned chuck is held within the above-mentioned body cylinder so as to be rotatable about an axis in a situation where the chuck grasps the above-mentioned writing lead, a rotational drive mechanism is provided where a rotor is retreated and moved forward by writing pressure of the above-mentioned writing lead through the above-mentioned chuck so that the above-mentioned rotor is rotationally driven, and rotational motion of the above-mentioned rotor is transmitted to the above-mentioned writing lead through the above-mentioned chuck, characterized in that an indicator is provided for a part of a component accommodated in the body cylinder which is rotationally driven interlocking with the above-mentioned rotor or rotation of the rotor, and the above-mentioned indicator can be observed through the above-mentioned body cylinder made of a transparent material.

In this case, in a preferred embodiment, the above-mentioned indicator is formed by way of surface treatment including printing or engraving, or of a notch. In the case where the above-mentioned indicator is formed by way of surface treatment including printing or engraving, it is desirable that indication is provided so as to change along a rotational circumferential direction.

Further, it is desirable that in the case where the above-mentioned indicator is formed of the notch, a portion to be provided with the above-mentioned notch and a portion to be exposed through the above-mentioned notch are each formed by a two-color molding method, so that the portion having the above-mentioned notch and the portion exposed therethrough are arranged to be different in color.

A preferred embodiment of the above-mentioned rotational drive mechanism is such that the rotor which constitutes the rotational drive mechanism is formed into the shape of a ring, first and second cam faces are respectively formed at one end face and another end face of the rotor in an axial direction, and first and second fixed cam faces are arranged on the above-mentioned body cylinder side so as to face the above-mentioned first and second cam faces, respectively, wherein the first cam face in the above-mentioned ring-shaped rotor is brought into abutment with and meshed with the above-mentioned first fixed cam face by retreat operation of the above-mentioned chuck by way of the above-mentioned writing pressure, and the second cam face in the above-mentioned ring-shaped rotor is brought into abutment with and meshed with the above-mentioned second fixed cam face by releasing the above-mentioned writing pressure, and wherein the second cam face on the above-mentioned rotor side and the above-mentioned second fixed cam face are arranged to have a half-phase shifted relationship with respect to one tooth of a cam in the axial direction in a situation where the first cam face on the above-mentioned rotor side is meshed with the above-mentioned first fixed cam face, and the first cam face on the above-mentioned rotor side and the above-mentioned first fixed cam face are arranged to have the half-phase shifted relationship with respect to one tooth of the cam in the axial direction in a situation where the second cam face on the above-mentioned rotor side is meshed with the above-mentioned second fixed cam face.

In this case, it is desirable that a spring member is provided which biases the second cam face in the above-mentioned ring-shaped rotor into abutment with the above-mentioned second fixed cam face and brings the second cam face and the second fixed cam face to mesh with each other in a situation where the above-mentioned writing pressure is released.

Furthermore, in addition to the above-described structure, it is desirable that a torque canceller which is formed cylindrically and generates a slide between itself and an rear end portion of the above-mentioned rotor is interposed between the rear end portion of the above-mentioned rotor and the above-mentioned spring member so as to prevent the rotational motion of the above-mentioned rotor from being transmitted to the above-mentioned spring member.

EFFECT OF THE INVENTION

According to the above-described mechanical pencil in accordance with the present invention, with application of the writing pressure, the rotor moves in the axial direction so that the first cam face of the rotor is brought to mesh with the first fixed cam face, and is subjected to rotational motion. Further, as the writing pressure is released, the rotor returns to the original position, and then operates so as to bring the second cam face of the rotor to mesh with the second fixed cam face so as to be subjected to the rotational motion in the same direction as in the above description. As the rotational motion of the above-mentioned rotor by way of the writing pressure is transmitted to the writing lead through the chuck, it is possible to prevent the local abrasion of the writing lead according to the progress of the writing and to solve the problem that the thickness of a drawn line and the boldness of the drawn line may change badly.

In addition, the indicator is provided for a part of the component accommodated in the body cylinder which is rotationally driven interlocking with the above-mentioned rotor or rotation of the rotor, and the above-mentioned indicator can be observed through the above-mentioned body cylinder made of a transparent material, whereby rotational drive behavior of the rotor (writing lead) can be observed as the above-mentioned indicator rotates and moves when writing. In use, this structure may cause a user to have interests or a pleasure somewhat, and it also appeals considerable product differentiation. Further, in operation inspection at the time of manufacturing and assembling the mechanical pencil, it is also possible to ease quality judgment by viewing.

Further, according to the mechanical pencil in accordance with the present invention, since a drive portion for rotating it, except for the writing lead, can be arranged to be accommodated in the body cylinder, it is possible to solve the above-mentioned problem in the structure of the mechanical pencil where the knock cap and the base are rotated interlocking with the rotational drive mechanism, as described in patent documents 1 to 3.

DESCRIPTION OF REFERENCE NUMERALS AND SIGNS

Figure 1:
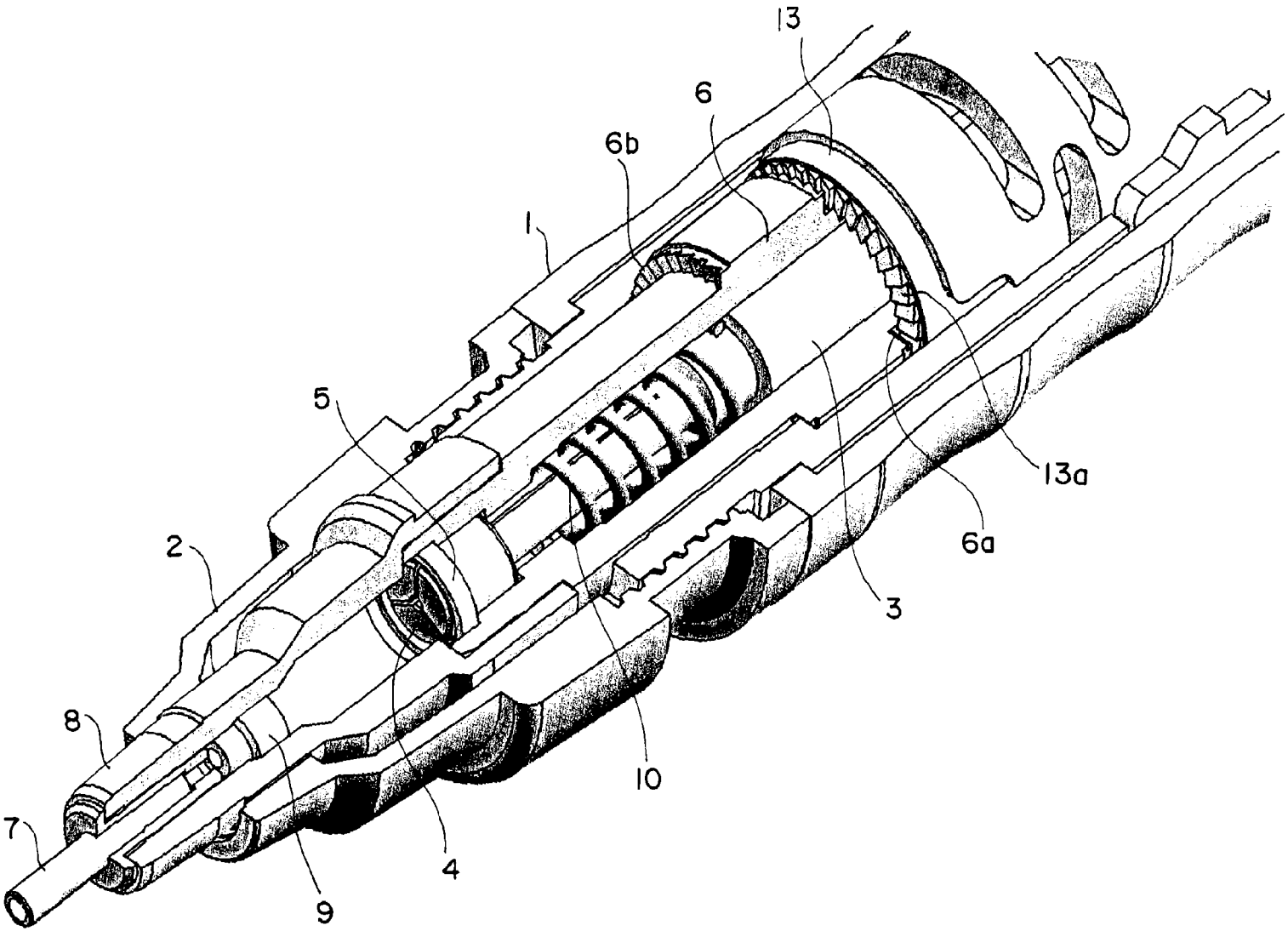
FIG. 1 is a perspective view of a first half part (partially broken-away) of a mechanical pencil in accordance with the present invention.

1: body cylinder
2: base

3: lead case
4: chuck
5: clamp
6: rotor
6*a*: first cam face
6*b*: second cam face
6*c*: indicator
7: pipe end
8: support member
9: holder chuck
10: return spring
13: upper cam formation member
13*a*: first fixed cam face 14: lower cam formation member
14*a*: second fixed cam face
16: stopper
17: torque canceller
18: spring member
21: knock bar
22: spring member
23: clip
26: knock cover
27: writing lead feeding hole
61: larger diameter portion
62: cylinder body

BEST MODE FOR CARRYING OUT THE INVENTION

Figure 2:
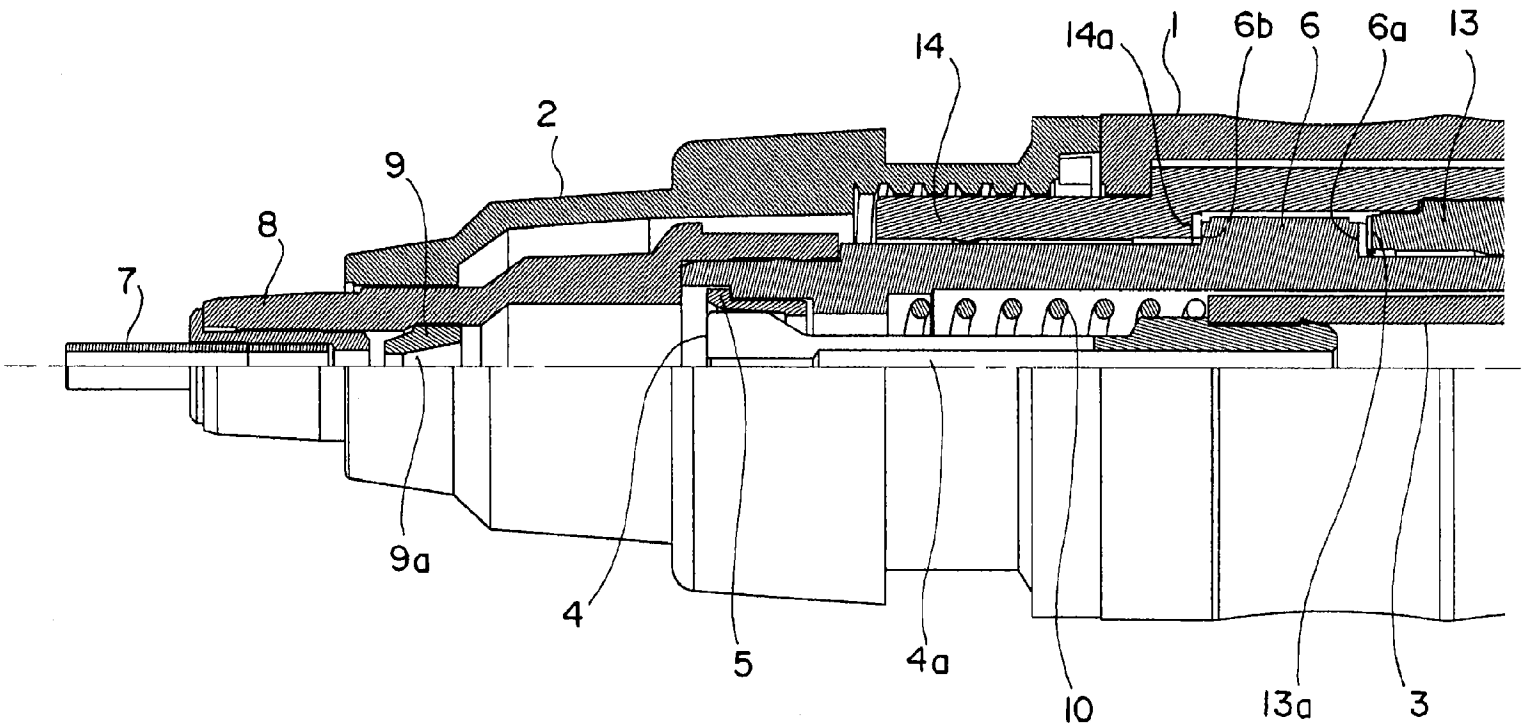
FIG. 2 is a fragmentary sectional side elevation similarly showing the first half part.

Hereinafter, a mechanical pencil in accordance with the present invention will be described with reference to the embodiments illustrated in the drawings. FIGS. 1 and 2 show a first half part of the mechanical pencil which is a principal part of the present invention. FIG. 1 is a perspective view showing its principal part, partially broken-away, and FIG. 2 is a side elevation where a left half portion is shown in section.

Reference numeral 1 denotes a body cylinder which constitutes the exterior, and reference numeral 2 indicates a base attached to a tip portion of the above-mentioned body cylinder 1. A cylindrical lead case 3 is accommodated coaxially in the center of the above-mentioned body cylinder 1, and a chuck 4 is connected with a tip portion of the lead case 3. The chuck 4 is mounted so that a through hole 4*a* is formed along an axis thereof, a tip portion is divided in three directions, and the divided tip portions are loosely fitted in a clamp 5 which is formed in the shape of a ring. The above-mentioned ring-shaped clamp 5 is mounted inside a tip portion of a rotor 6 which is arranged to cover the perimeter of the above-mentioned chuck 4 and which is formed cylindrically.

A pipe end 7 is arranged so as to project from the above-mentioned base 2, and an end portion of the pipe end 7 is fitted to an inner surface of a tip portion of a support member 8 as an intermediate member located in the above-mentioned base 2. The above-mentioned support member 8 is formed whose diameter gradually increases towards its end portion (rear end portion) side and whose cylindrical portion is integrally formed in the shape of a staircase. Fitted to its inner surface of the end portion is a circumferential surface at the tip portion of the above-mentioned rotor 6. Further, a holder chuck 9 made of rubber which has formed a through hole 9*a* in an axis portion is fitted to the circumferential surface at the support member 8 for supporting the above-mentioned pipe end 7.

According to the above-mentioned structure, a linear lead inserting hole is so formed as to pass via a through hole 4*a* formed in the chuck 4 and a through hole 9*a* formed along the axis of the above-mentioned holder chuck 9 from the lead case 3 to the above-mentioned pipe end 7. A writing lead (refill lead; not shown) is inserted into the linear lead inserting hole. Further, a return coil-spring 10 is arranged at a space between the above-mentioned rotor 6 and chuck 4. In addition, one end portion (rear end portion) of the above-mentioned return spring is accommodated in abutment with an end face of the above-mentioned lead case 3 and another end portion (front end portion) of the above-mentioned return spring 10 is accommodated in abutment with an annular end face formed in the rotor 6. Therefore, the chuck 4 in the rotor 6 is biased to retreat by action of the above-mentioned return spring 10.

In the mechanical pencil shown in the drawings, when knock operation of a knock part (to be set forth later) which is disposed at a rear end portion of the body cylinder 1 is carried out, the above-mentioned lead case 3 advances in the body cylinder 1. The tip of the chuck 4 projects from a clamp 5 to cancel a grasp state of the writing lead. With cancellation of the above-mentioned knock operation, the lead case 3 and the chuck 4 retreat in the body cylinder 1 by the action of a return spring 10.

At this time, the writing lead is held in the through hole 9*a* formed at the holder chuck 9. In this situation, the chuck 4 retreats and a tip portion of the chuck 4 is accommodated in the above-mentioned clamp 5, thus the writing lead again comes into the grasp state. In other words, the writing lead is grasped and released when the chuck 4 moves back and forth by repeating the knock operation of the above-mentioned knock part, whereby the writing lead operates to inch forward from the chuck 4 stepwise.

The above-mentioned rotor 6 shown in FIG. 1 is formed such that a central part in the axial direction is increased in diameter to have a larger diameter portion in which a first cam face 6*a* is formed at one end face (rear end face) of the larger diameter portion, and a second cam face 6*b* is formed at the other end face (front end face) of the larger diameter portion. On the other hand, at the rear end portion of the above-mentioned rotor 6, a cylindrical upper cam formation member 13 is mounted in the body cylinder 1 so as to cover the rear end portion of the rotor 6. At the front end portion of the above-mentioned upper cam formation member 13, a fixed cam face (also referred to as "first fixed cam face") 13*a* is formed so as to face the first cam face 6*a* in the above-mentioned rotor 6.

Furthermore, although not shown in FIG. 1 but shown in FIG. 2, a cylindrical lower cam formation member 14 is mounted on the body cylinder 1 side so as to face the second cam face 6*b* in the above-mentioned rotor 6, and a fixed cam face (also referred to as "second fixed cam face") 14*a* is formed at the rear end portion in the axial direction. In addition, a relationship and mutual operation among the first and the second cam faces 6*a* and 6*b* which are formed at the above-mentioned rotor 6, the above-mentioned first fixed cam face 13*a*, and the second fixed cam face 14*a* will be described in detail later with reference to FIGS. 4 and 5.

Figure 3:
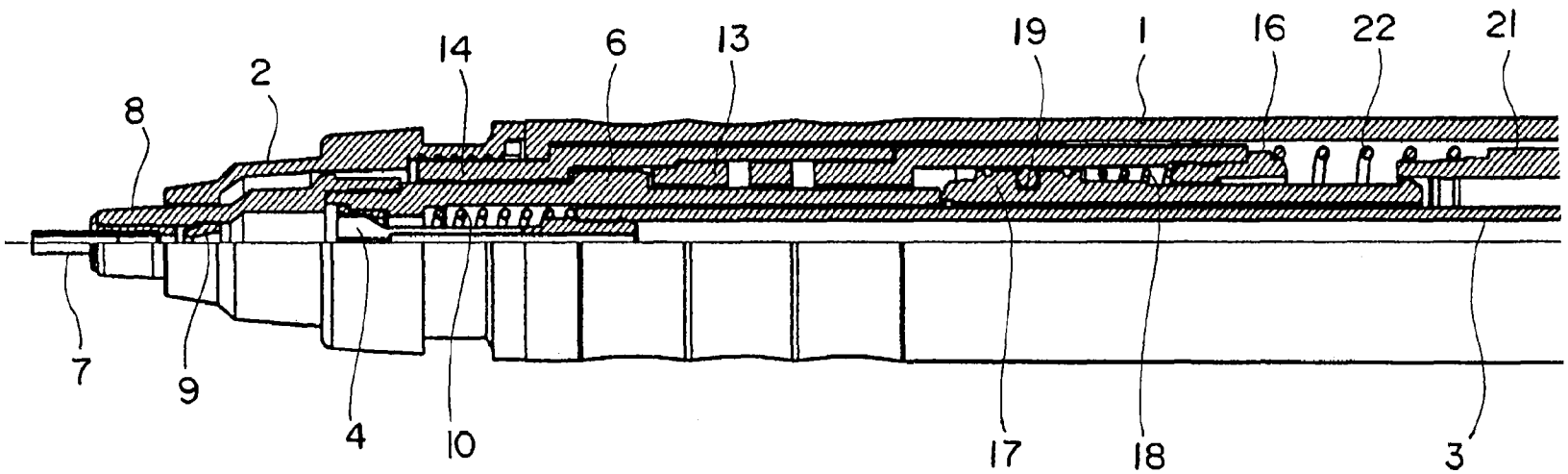
FIG. 3 is a fragmentary sectional side elevation further showing a rear portion of the mechanical pencil.

FIG. 3 further shows a farther portion of the mechanical pencil shown in FIGS. 1 and 2, and typical parts shown in FIGS. 1 and 2 are indicated by the same reference numerals. As shown in FIG. 3, a cylindrical stopper 16 is fitted to the rear end portion inside the upper cam formation member 13 which is formed cylindrically, and a coil-spring member 18 is provided between a front end portion of the stopper 16 and the torque canceller 17 which is formed cylindrically and can move in the axial direction.

It is arranged that the above-mentioned spring member 18 acts so as to bias forward the above-mentioned torque canceller 17 and the above-mentioned rotor 6 is pushed to move forward by the above-mentioned torque canceller 17 subjected to this bias force.

According to the above-mentioned structure, in a situation where the chuck 4 grasps the writing lead, the above-mentioned rotor 6 together with the chuck 4 is accommodated in the above-mentioned body cylinder 1 so as to be rotatable about the axis. Further, in a situation where the mechanical pencil is not in use (or not in writing state), the rotor 6 is biased forward by the action of the above-mentioned spring member 18 through the above-mentioned torque canceller 17, resulting in a situation shown in FIGS. 1 to 3.

On the other hand, when the mechanical pencil is used, i.e., when the writing pressure is applied to the writing lead (not shown) protruding from the pipe end 7, the above-mentioned chuck 4 retreats against the bias force of the spring member 18. According to this operation, the rotor 6 also retreats in the axial direction. Therefore, the first cam face 6*a* formed at the rotor 6 shown in FIGS. 1 and 2 engages with and meshes with the above-mentioned first fixed cam face 13*a*.

FIGS. 4(A) to 4(C) and FIGS. 5(D) and 5(E) are for explaining in order the fundamental operation of a rotational drive mechanism which rotationally drives the rotor 6 by the above-mentioned operation. In FIGS. 4 and 5, reference numeral 6 indicates the above-mentioned rotor which is schematically shown, and at one end face thereof (upper face in figures) the first cam face 6*a* having a continuous sawtooth shape along a circumferential direction is formed into the shape of a ring. Further, similarly, the second cam face 6*b* having a continuous sawtooth shape along the circumferential direction is formed into the shape of a ring at the other end face (lower face in figures) of the rotor 6.

On the other hand, as shown in FIGS. 4 and 5, the first fixed cam face 13*a* having a continuous sawtooth shape along the circumferential direction is also formed at a ring-shaped end face of the upper cam formation member 13, and the second fixed cam face 14*a* having a continuous sawtooth shape along the circumferential direction is also formed at a ring-shaped end face of the lower cam formation member 14. The cam faces formed into the sawtooth shape along the circumferential direction at the first cam face 6*a* and the second cam face 6*b* formed at the rotor, the first fixed cam face 13*a* formed at the upper cam formation member 13, and the second fixed cam face 14*a* formed at the lower cam formation member 14 are each arranged to have substantially the same pitch.

In addition, circle (○) shown by reference sign 6*c* and drawn in the center of the rotor 6 illustrated in FIGS. 4 and 5 is an indicator for indicating rotational movement of the rotor 6. Although the indication shown by one circle (○) is given in this example, it may be arranged so that a plurality of indications are suitably provided along a circumferential direction. The indicator shown by reference sign 6*c* functions to allow a user to observe an internal rotation state through the body cylinder 1 and the lower cam formation member 14 which are formed of a transparent material. Other preferred examples of structures of this indicator 6*c* will be described in detail later.

Figure 4A:
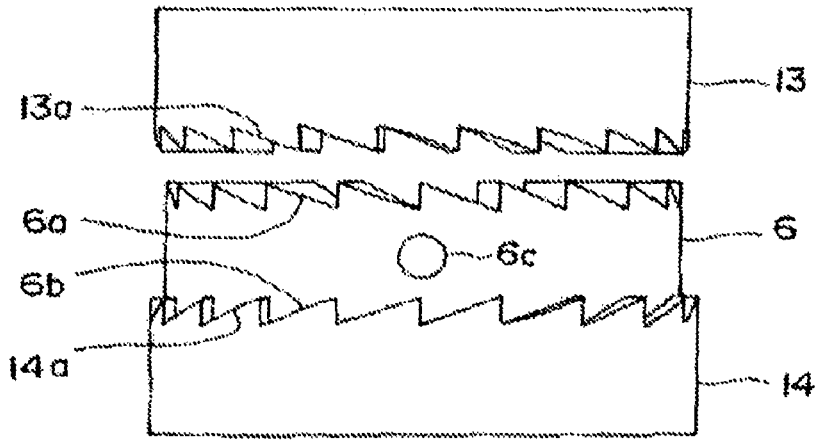
FIGS. 4A, 4B and 4C are schematic views for explaining, in order, rotational drive actions of a rotor employed in embodiments as shown in FIGS. 1 to 3.

FIG. 4(A) shows a relationship among the upper cam formation member 13, the rotor 6, and the lower cam formation member 14 in the situation where the mechanical pencil is not in use (or not in writing state). In this situation, by the bias force of the spring member 18 shown in FIG. 3, the second cam face 6*b* formed in the rotor 6 is brought into abutment with the second fixed cam face 14*a* side of the lower cam formation member 14 mounted at the body cylinder 1. At this time, the first cam face 6*a* on the above-mentioned rotor 6 side and the above-mentioned first fixed cam face 13*a* are arranged to have a half-phase (half-pitch) shifted relationship with respect to one tooth of the cam in the axial direction.

Figure 4B:
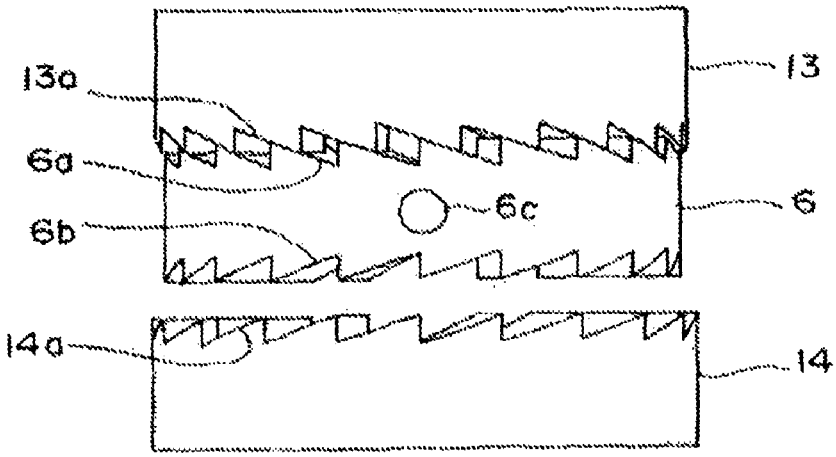

FIG. 4(B) shows an initial situation where the writing pressure is applied to the writing lead by use of the mechanical pencil. In this case, as described above, the rotor 6 compresses the above-mentioned spring member 18 and retreats in the axial direction while the chuck 4 retreats. Thus, the rotor 6 moves to the upper cam formation member 13 side mounted at the body cylinder 1.

Figure 4C:
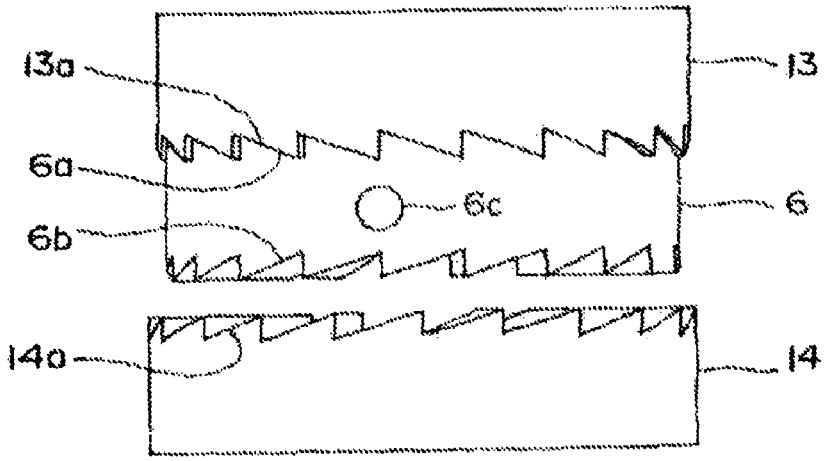

FIG. 4(C) shows a situation where the writing pressure is applied to the writing lead by use of the mechanical pencil and the rotor 6 comes into abutment with the upper cam formation member 13 side and retreats. In this case, the first cam face 6*a* formed at the rotor 6 meshes with the first fixed cam face 13*a* on the upper cam formation member 13 side. Thus, the rotor is subjected to rotational drive corresponding to the half-phase (half-pitch) with respect to one tooth of the first cam face 6*a*. Further, in the situation shown in FIG. 4(C), the second cam face 6*b* on the above-mentioned rotor 6 side and the above-mentioned second fixed cam face 14*a* are arranged to have a half-phase (half-pitch) shifted relationship with respect to one tooth of the cam in the axial direction.

Figure 5D:
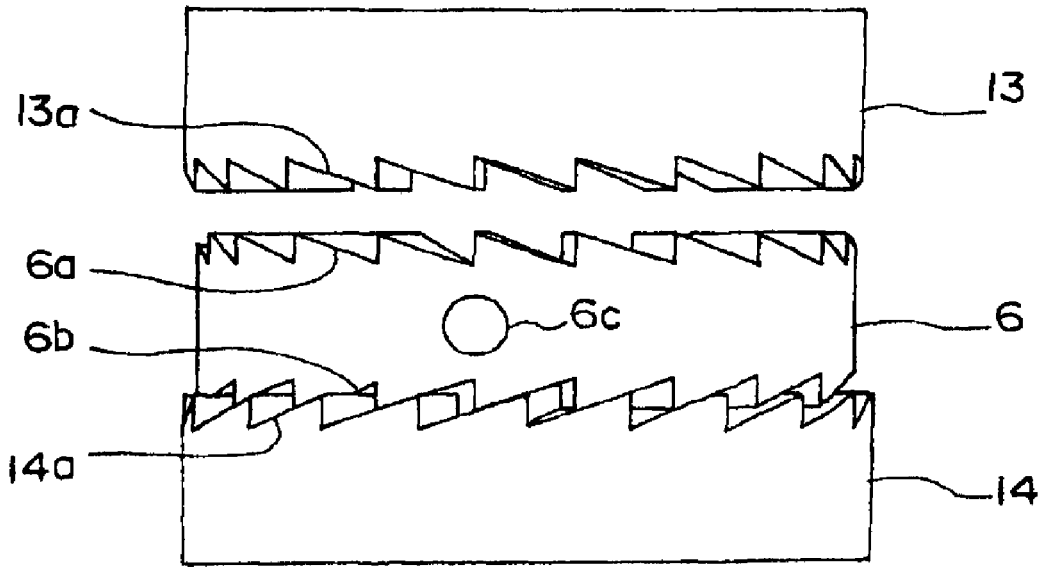
FIGS. 5D and 5E are schematic views for explaining the rotational drive actions of the rotor, following FIG. 4.

Next, FIG. 5(D) shows an initial situation where drawing with the mechanical pencil is finished and the writing pressure to the writing lead is released. In this case, the rotor 6 moves forward in the axial direction by action of the above-mentioned spring member 18. Thus, the rotor 6 moves to the lower cam formation member 14 side mounted at the body cylinder 1.

Figure 5E:
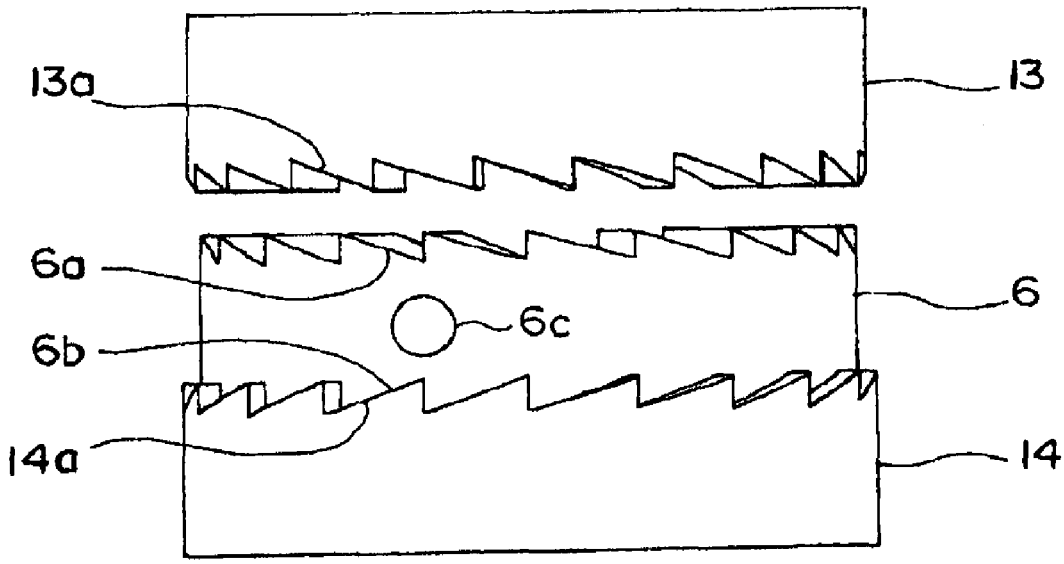

Furthermore, FIG. 5(E) shows a situation where the rotor 6 comes into abutment with the lower cam formation member 14 side and moves forward by action of the above-mentioned spring member 18. In this case, the second cam face 6*b* formed at the rotor 6 meshes with the second fixed cam face 14*a* on the lower cam formation member 14 side. Thus, the rotor 6 is subjected again to the rotational drive corresponding to the half-phase (half-pitch) of one tooth of the second cam face 6*b*.

Therefore, according to reciprocating movement of the rotor 6 (which is subjected to the writing pressure) in the axial direction, the rotor 6 is subjected to the rotational drive corresponding to one tooth (one pitch) of the first and second cam faces 6*a* and 6*b*, and the writing lead 10 grasped by the chuck 4 is rotationally driven through the chuck 4 similarly. Its rotational drive behavior can be observed as the indicator 6*c* shown by circle (○) drawn in the center of the rotor 6 moves as described above.

According to the mechanical pencil having the structure as described above, each time the writing causes the rotor 6 to reciprocate in the axial direction, the rotor is subjected to the rotational motion corresponding to one tooth of the cam. By repeating this operation, the writing lead is rotationally driven stepwise. Therefore, it is possible to prevent the writing lead from locally abrading as the writing proceeds, and it is also possible to solve the problem that the boldness of the drawn line and the thickness of the drawn line may change badly.

Furthermore, according to the mechanical pencil having the structure as described above, the pipe end 7 for guiding the writing lead and arranged to project from the base 2 is fitted to the tip portion of the above-mentioned rotor 6 through the support member 8 which functions as the intermediate member. Thus, as the above-mentioned chuck 4 retreats and moves forward in conjunction with the writing operation, the pipe end 7 moves in the same direction through the support member 8. Therefore, if the writing lead reciprocates slightly (hereinafter referred to as "cushion action") in conjunction with the writing operation, the pipe end for guiding the writing lead also moves in the same direction, whereby relative movement in the axial direction does not take place between the pipe end and the writing lead and an protrusion length of the writing lead from the pipe end can be kept constant.

Further, the pipe end 7 is connected with the above-mentioned rotor 6 through the support member 8. Thus, when the writing lead is subjected to the rotational movement, the pipe end is also subjected to the rotational movement similarly, so that the pipe end 7 and the writing lead rotate together.

Therefore, according to the mechanical pencil with the above-described structure, it is possible to solve the problem that when writing, the protrusion length of the writing lead protruding from a base member or the pipe end changes each time and the user feels the sense of uncomforting. Further, the lead can be prevented from being broken due to the lead scraping at the pipe end, which is caused by the changes in the protrusion length of the writing lead from the pipe end and it is also possible to solve the problem that the paper surface is smeared by scraping of the lead.

In addition, with application of the bias force of the above-mentioned coil-like spring member 18, the cylindrical torque canceller 17, which moves forward the rotor 6, generates a slide between a front end face of the torque canceller 17 and a rear end face of the above-mentioned rotor 6 and acts so that the rotational motion of the above-mentioned rotor 6 generated by repetition of the writing action is prevented from being transmitted to the spring member 18.

In other words, since the torque canceller 17 formed cylindrically is interposed between the above-mentioned rotor and the spring member 18, the rotational motion of the above-mentioned rotor is prevented from being transmitted to the above-mentioned spring member, and it is possible to solve the problem that back torsion (spring torque) of the spring member 18 occurs and places an obstacle to rotation operation of the rotor 6.

Further, in the illustrated embodiment, as shown in FIG. 3, an annular groove is formed along a circumference side of the torque canceller 17, and an O-ring 19 made of rubber is fitted into the groove. When the torque canceller 17 moves backward with application of the writing pressure, the above-mentioned O-ring 19 slides on an inner circumference of the above-mentioned upper cam formation member 13 and acts so as to function as a damper.

In other words, during the above-mentioned cushion operation against the bias force of the spring member 18 shown in FIG. 3, there arises a feel of "clatter" or "click" when writing, leaving a problem in bad feeling. Then, as shown in FIG. 3, the O-ring 19 is arranged along a circumferential side of the torque canceller 17, allowing the above-mentioned dumper function which is used to reduce the above-mentioned problem.

Figure 6:
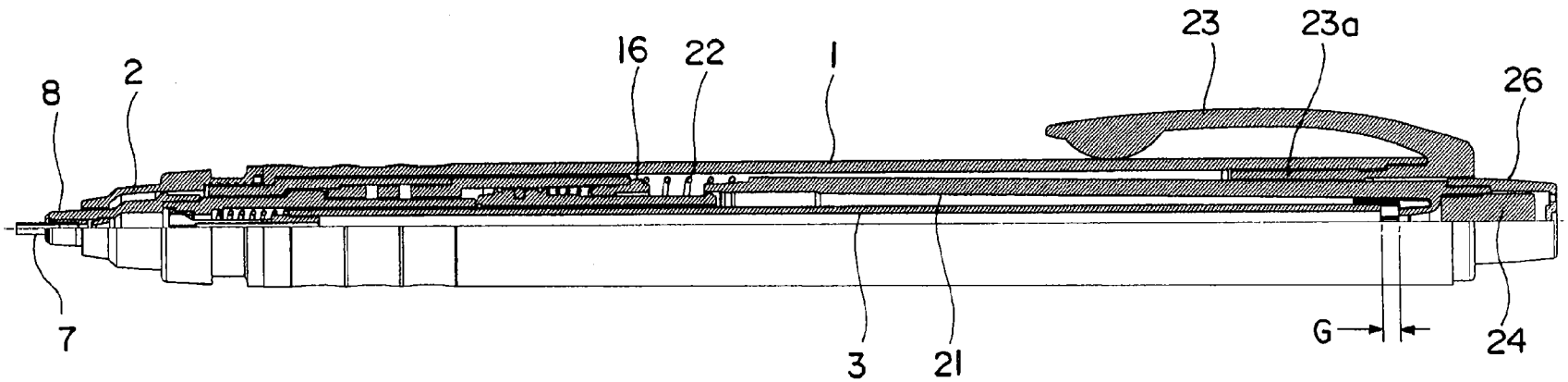
FIG. 6 is a fragmentary sectional side elevation showing the whole structure in the preferred embodiments shown in FIGS. 1 to 3.
Figure 7:
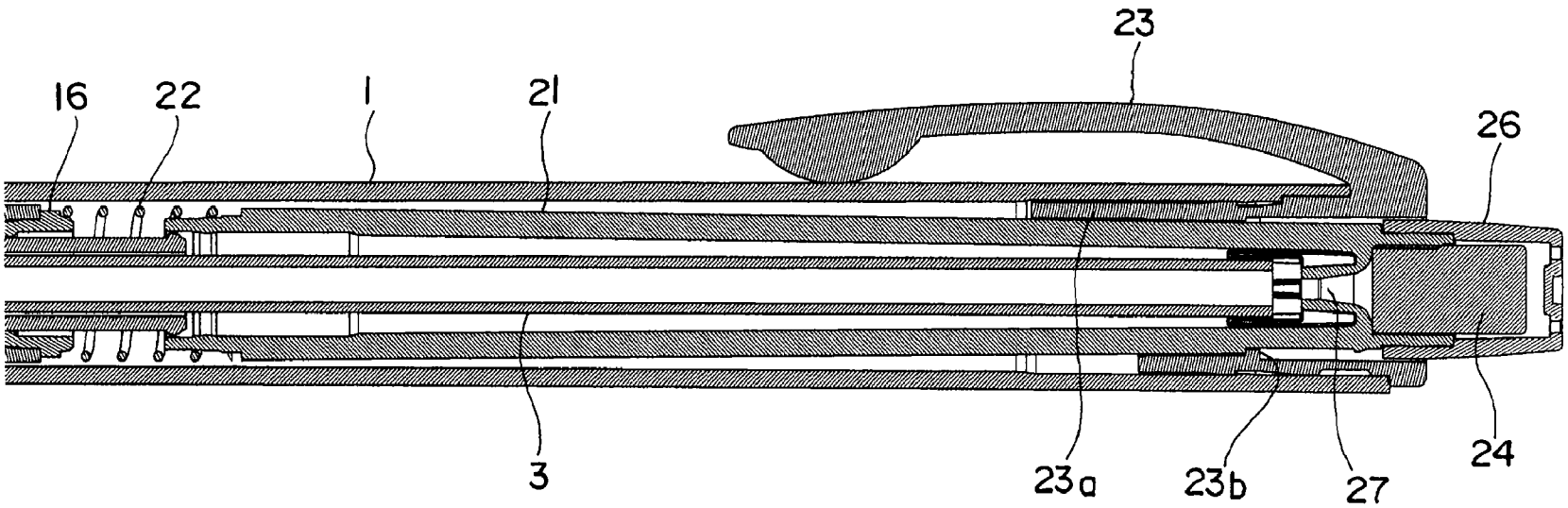
FIG. 7 is an enlarged sectional view similarly showing a second half part.

FIG. 6 shows the whole structure of the mechanical pencil provided with the above-mentioned function, and its second half is enlarged and shown in FIG. 7. Further, FIG. 6 illustrates a left half portion in section with a side elevation and FIG. 7 illustrates it in section. In FIGS. 6 and 7, like reference signs indicate like parts that are typically shown in each drawing as already described.

As shown in FIGS. 6 and 7, a knock bar 21 formed cylindrically is accommodated between the body cylinder 1 and the lead case 3 inside the rear end side of the body cylinder 1. The knock bar 21 is arranged to be biased rearward at its front end portion by a coil-spring member 22 arranged between a rear end portion of the above-mentioned stopper 16 and the knock bar itself. Further, it is arranged that a cylinder body 23*a* in which a clip 23 is integrally formed at a rear end portion of the body cylinder 1 is fitted into the body cylinder 1 and the above-mentioned knock bar 21 is prevented from protruding towards the rear end side of the body cylinder 1 by a step portion 23*b* formed inside the cylinder body 23*a* as shown in FIG. 7.

The rear end portion of the above-mentioned knock bar 21 is arranged to project a little farther than a rear end portion of the above-mentioned cylinder body 23*a*, and an eraser 24 is accommodated in an inside space at the rear end portion of the above-mentioned knock bar 21. Further, the knock cover 26 which constitutes the knock part so as to cover the above-mentioned eraser 24 is detachably provided so as to cover a perimeter side of the rear end portion of the knock bar 21.

On the other hand, as shown in FIG. 7, a writing lead feeding hole 27 having a diameter smaller than an inner diameter of the knock bar 21 is formed immediately before the rear end portion in the knock bar 21. As shown in FIG. 6, it is arranged that a front end portion of the above-mentioned feeding hole 27 faces a rear end portion of the above-mentioned lead storage 3 to have a small gap G. In other words, in this embodiment, the lead storage 3 is not mechanically connected with the above-mentioned knock bar 21 but separated in the position of the above-mentioned gap G.

In the above structure, when the knock operation of the above-mentioned knock cover 26 is carried out, it acts so that the front end portion of the above-mentioned feeding hole 27 comes into abutment with the rear end portion of the lead storage 3 through the knock bar 21 so as to inch the lead storage 3 forward, maintaining the abutment. Thereby, as described above, the chuck 4 moves forward and operates to inch the writing lead out of the pipe end 7. Then, on releasing the above-mentioned knock operation, the knock bar 21 is retreated by action of the spring member 22, and the knock bar 21 is held by the step portion 23*b* formed inside the cylinder body 23*a* which supports the clip 23.

According to the structure as described above, since the gap G is formed between the front end portion of the writing lead feeding hole 27 formed on the rear end side of the knock bar 21 and the rear end portion of the above-mentioned lead storage 3, the rear end portion of the lead case 3 does not impact on the front end portion of the above-mentioned feeding hole 27 in the case of the retreat operation of the chuck 4 and the lead case 3 when writing. In the presence of the above-mentioned gap G, the rotation operation of the lead case 3 caused by the above-mentioned rotational drive mechanism is not transmitted to the knock cover 26 side.

In other words, even if the knock cover 26 is rotated by a finger etc., the rotation operation is not transmitted to the above-mentioned rotational drive mechanism through the lead case 3, and it is possible to solve the problem that excessive rotation of the knock cover 26 may place an obstacle to the rotational drive mechanism.

Further, formation of the above-mentioned gap G can solve the problem that the function of the above-mentioned rotational drive mechanism for rotationally driving the writing lead is stopped when the above-mentioned knock cover 26 projecting at the rear end portion of the body cylinder is in contact with something.

Figure 8:
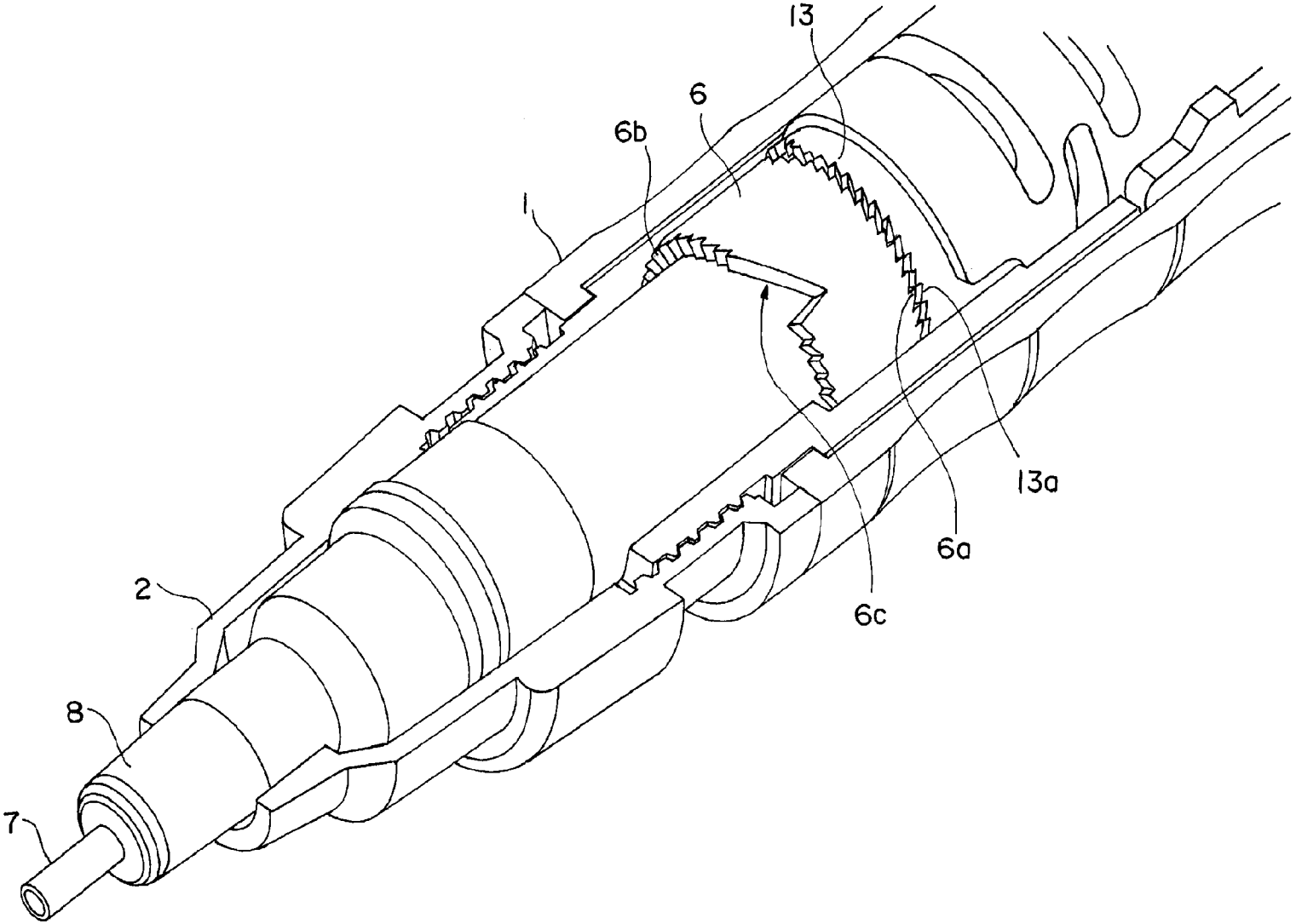
FIG. 8 is a perspective view showing an example of a structure of an indicator which indicates a rotational drive state of the rotor.

Next, FIG. 8 shows an example of a structure in which the rotational drive state of the rotor 6 is illustrated with respect to the mechanical pencil in accordance with the present invention. In addition, FIG. 8 illustrates the rotor 6 and the support member 8, not in section, in a similar situation as already described with reference to FIG. 1. In FIG. 8, like reference signs indicate like parts that are shown in FIG. 1 and the description thereof will not be repeated.

An example shown in FIG. 8 illustrates a wedge-shaped notch (with the same reference sign 6*c* as that of indicator) which serves as the indicator and is provided by cutting away a part of the second cam face 6*b* in the rotor 6. The structure of the rotor 6 itself shown in this example is illustrated with a front view in FIG. 9(A). It is possible to form a plurality of wedge-shaped notches 6*c* in the circumferential direction, as needed. Further, the above-mentioned notch 6*c* can be observed from the exterior through the body cylinder 1 and the lower cam formation member 14 which are formed of the transparent material.

Thus, in the rotor 6, the wedge-shaped notch 6*c* which is comparatively large sized is formed as the indicator, so that apart cut in the shape of a wedge may move in the circumferential direction as the rotor 6 rotates, whereby a user can recognize that the writing lead is surely rotationally driven when writing.

In this case, it is desirable that a portion in which the above-mentioned notch 6*c* is provided and a portion which is exposed through the above-mentioned notch are each formed by a two-color molding method, so that the above-mentioned notch portion and the portion exposed therethrough are arranged to be different in color.

Figure 9C:
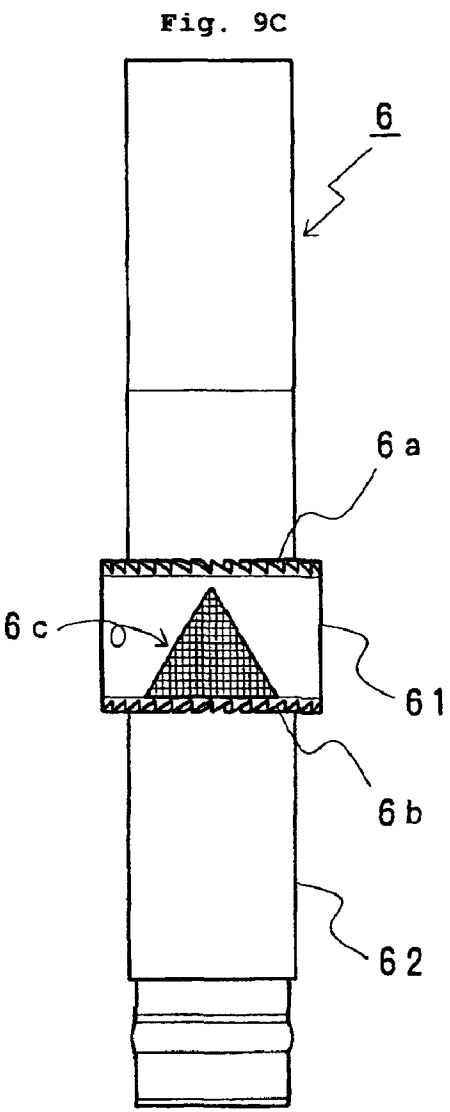
FIGS. 9A, 9B and 9C are front views of the rotor itself illustrating examples of structures of other indicators including the example shown in FIG. 8.
Figure 9B:
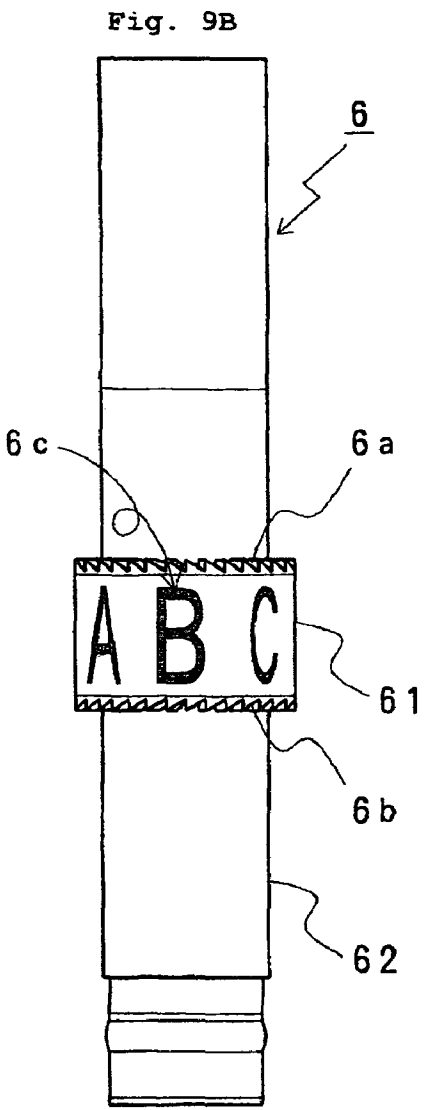
Figure 9A:
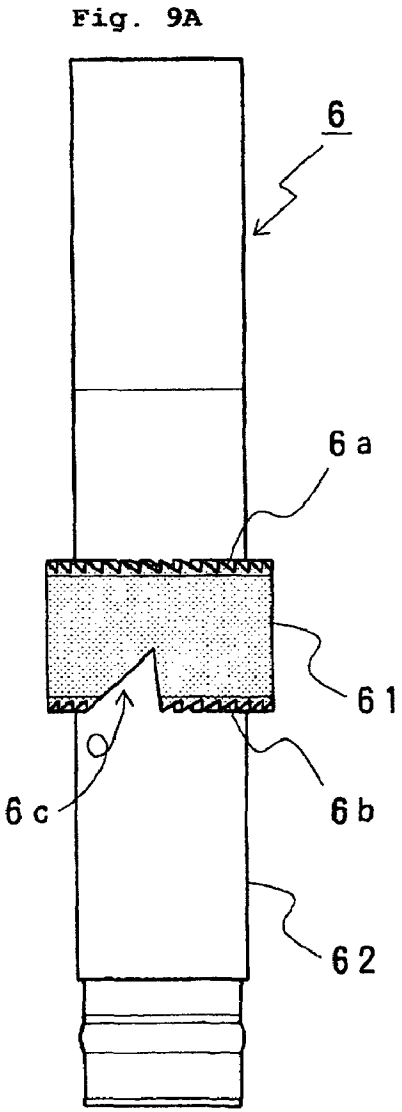

In other words, as shown in FIG. 9(A), a cylinder body 62 which constitutes the rotor 6 and is long in the axial direction and a larger diameter portion 61 which is formed in the center thereof to form the first cam face 6*a* and second cam face 6*b* are molded by way of the two-color molding method, so that a different color of the material of the cylinder body 62 is exposed to the cut-out portion of the notch 6*c* formed at the larger diameter portion 61. Thus, the indicator 6*c* constituted by the notch can be shown clearly.

FIGS. 9(B) and 9(C) each show examples in which the rotational drive state of the rotor 6 is similarly illustrated by means of the rotor 6 itself. In other words, FIG. 9(B) shows that characters (A, B, and C in the drawing) are displayed, for example by printing, along the circumferential direction of the larger diameter portion 61 so as to serve as the indicator 6*c*. FIG. 9(C) shows that the triangular indicator 6*c* is provided for the larger diameter portion 61 by way of laser beam machining, for example. In the example shown in FIG. 9(C) above, a plurality of triangular indicators 6*c* may be provided along the circumferential direction as needed. Alternatively, the indicator 6*c* may be provided not only by the above-mentioned laser beam machining but also by other surface treatments including engraving, for example.

In addition, as shown in FIGS. 9(B) and 9(C), when forming the indicator 6*c* by way of surface treatment including printing or engraving etc., it is desirable that the indication is provided so as to change along a rotational circumferential direction as with the example shown in the drawing. In other words, according to the examples shown in FIGS. 9(B) and 9(C), it becomes possible to indicate the rotation state of the rotor more clearly, as compared with the case where the indicator that does not change along the rotational circumferential direction is formed in the shape of a stripe, for example.

Figure 10:
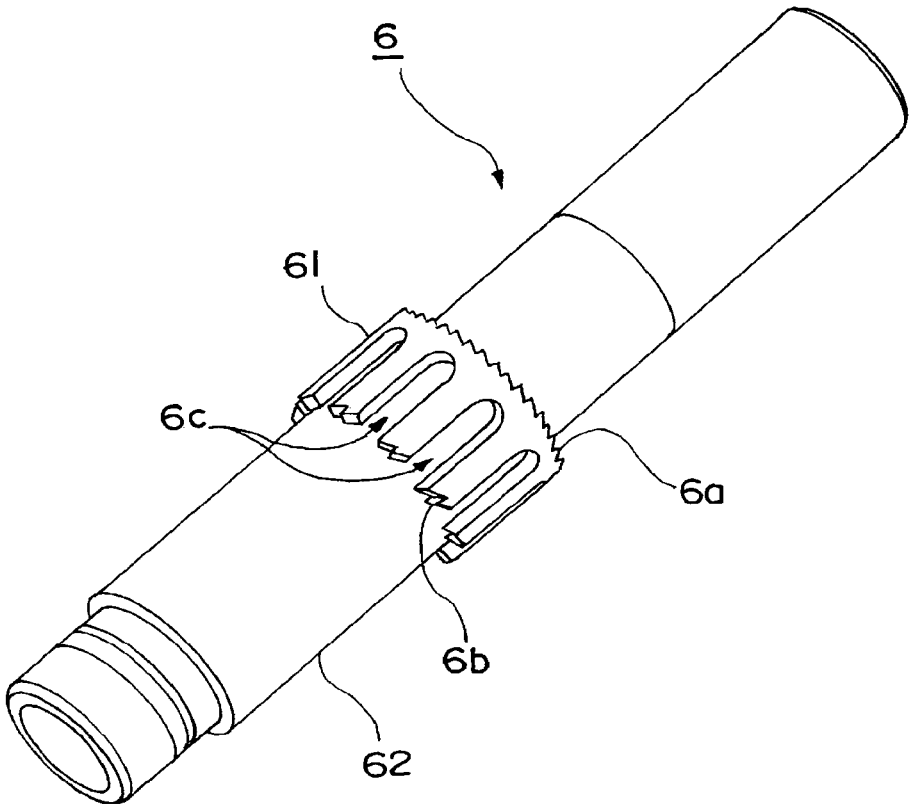
FIG. 10 is a perspective view of the rotor itself further illustrating an example of a structure of another indicator.

FIG. 10 shows still another example of a structure which indicates the rotational drive state of the rotor 6, and the rotor 6 itself is shown with a perspective view in FIG. 10. In this example, the larger diameter portion 61 is provided with a plurality of slit-like notches 6*c* in such a way that portions of the second cam face 6*b* in the rotor 6 are cut away, thus forming the indicator.

Also in the example shown in FIG. 10, the cylinder body 62 and the larger diameter portion 61 are molded by way of a two-color molding method, so that a different color of the material of the cylinder body 62 is exposed to the cut-out portion of the slit-like notch 6*c*. Thus, the indicator 6*c* constituted by the notches can be shown clearly.

Although each indicator 6*c* as described above is formed at the larger diameter portion 61 of the rotor 6, this indicator 6*c* may be provided for a part of a component accommodated in the body cylinder 1 which is rotationally driven interlocking with rotation of the rotor and the indicator can be observed through the above-mentioned body cylinder made of the transparent material.

For example, in the example shown in FIGS. 6 and 7, a grid-like (for example) indicator is formed in which white and black solid portions are arranged alternately at the entire circumference of the lead case 3, and the knock bar 21 is formed of the transparent material, so that the indicator provided for the entire circumference of the lead case 3 can be observed through the body cylinder 1 and the knock bar 21. Thus, the function similar to those in the examples shown in FIGS. 8-10 can be achieved.

As is clear from the above description, according to the mechanical pencil in accordance with the present invention, it is arranged that the indicator is provided for a part of the component accommodated in the body cylinder which is rotationally driven interlocking with the rotor or the rotation of the rotor and the above-mentioned indicator can be observed through the above-mentioned body cylinder made of the transparent material, thus obtaining the original operational effect as described in the column of the above-mentioned "effect of invention".

The invention claimed is:

1. A mechanical pencil arranged to grasp and release a writing lead by reciprocation of a chuck provided in a body cylinder so as to inch said writing lead forward, in which said chuck is held within said body cylinder so as to be rotatable about an axis in a situation where the chuck grasps said writing lead, a rotational drive mechanism is provided where a rotor is retreated and moved forward by writing pressure of said writing lead through said chuck so that said rotor is rotationally driven, and rotational motion of said rotor is transmitted to said writing lead through said chuck, characterized in that an indicator is provided for a part of a component accommodated in the body cylinder which is rotationally driven interlocking with said rotor or rotation of said rotor, and said indicator can be observed through said body cylinder made of a transparent material.

2. The mechanical pencil as claimed in claim 1, characterized in that said indicator is formed by way of surface treatment including printing or engraving, or of a notch.

3. The mechanical pencil as claimed in claim 2, characterized in that said indicator is formed by way of surface treatment including printing or engraving, and indication is provided so as to change along a rotational circumferential direction.

4. The mechanical pencil as claimed in claim 2, characterized in that said indicator is formed of the notch, a portion to be provided with said notch and a portion to be exposed through said notch are each formed by a two-color molding method, so that the portion having said notch and the portion exposed therethrough are arranged to be different in color.

5. The mechanical pencil as claimed in any one of claims 1 to 4, characterized in that said rotor which constitutes said rotational drive mechanism is formed into the shape of a ring, first and second cam faces are respectively formed at one end face and another end face of the rotor in an axial direction, and first and second fixed cam faces are provided which are arranged on said body cylinder side so as to face said first and second cam faces, respectively, said first cam face in the ring-shaped rotor is brought into abutment with and meshed with said first fixed cam face by retreat operation of said chuck by way of said writing pressure, and the second cam face in said ring-shaped rotor is brought into abutment with and meshed with said second fixed cam face by releasing said writing pressure, and the second cam face on said rotor side and said second fixed cam face are arranged to have a half-phase shifted relationship with respect to one tooth of a cam in the axial direction in a situation where the first cam face on said rotor side is meshed with said first fixed cam face, and the first cam face on said rotor side and said first fixed cam face are arranged to have the half-phase shifted relationship with respect to one tooth of the cam in the axial direction in a situation where the second cam face on said rotor side is meshed with said second fixed cam face.

6. The mechanical pencil as claimed in claim 5, characterized by comprising a spring member for biasing the second cam face of said ring-shaped rotor into abutment with said second fixed cam face and bringing the second cam face and the second fixed cam face to mesh with each other in a situation where said writing pressure is released.

7. The mechanical pencil as claimed in claim 6, characterized in that a torque canceller which is formed cylindrically and generates a slide between itself and a rear end portion of said rotor is interposed between the rear end portion of said rotor and said spring member so as to prevent the rotational motion of said rotor from being transmitted to said spring member.

* * * * *